US009968989B2

(12) United States Patent
Deters et al.

(10) Patent No.: US 9,968,989 B2
(45) Date of Patent: May 15, 2018

(54) LITHIUM-CONTAINING MOLDING MATERIAL MIXTURE BASED ON AN INORGANIC BINDER FOR PRODUCING MOLDS AND CORES FOR METAL CASTING

(71) Applicant: ASK Chemicals GmbH, Hilden (DE)

(72) Inventors: Heinz Deters, Düsseldorf (DE); Hannes Lincke, Köln (DE); Ronja Resch, Velbert (DE)

(73) Assignee: ASK CHEMICALS GMBH, Hilden (DE)

( * ) Notice: Subject to any disclaimer, the term of this patent is extended or adjusted under 35 U.S.C. 154(b) by 343 days.

(21) Appl. No.: 14/899,331

(22) PCT Filed: Jun. 17, 2014

(86) PCT No.: PCT/DE2014/000306
§ 371 (c)(1),
(2) Date: Dec. 17, 2015

(87) PCT Pub. No.: WO2014/202042
PCT Pub. Date: Dec. 24, 2014

(65) Prior Publication Data

US 2016/0136724 A1 May 19, 2016

(30) Foreign Application Priority Data

Jun. 17, 2013 (DE) ..... 10 2013 106 276

(51) Int. Cl.
*B22C 1/02* (2006.01)
*B22C 1/18* (2006.01)
*B22C 9/12* (2006.01)

(52) U.S. Cl.
CPC ..... *B22C 1/02* (2013.01); *B22C 1/183* (2013.01); *B22C 1/188* (2013.01); *B22C 9/123* (2013.01)

(58) Field of Classification Search
CPC B22C 1/02; B22C 1/183; B22C 1/188; B22C 9/123
See application file for complete search history.

(56) References Cited

U.S. PATENT DOCUMENTS

| | | | |
|---|---|---|---|
| 4,162,238 | A | 7/1979 | Bergna |
| 4,194,918 | A | 3/1980 | George |
| 4,316,744 | A | 2/1982 | Bergna |
| 4,347,890 | A | 9/1982 | Ailin-pyzik |
| 4,810,300 | A | 3/1989 | Holcombe |
| 5,057,155 | A | 10/1991 | Nakayama |
| 5,204,055 | A | 4/1993 | Sachs |
| 5,474,606 | A | 12/1995 | Twardowska |
| 5,911,269 | A | 6/1999 | Brander |
| 6,610,429 | B2 | 8/2003 | Bredt |
| 7,770,629 | B2 | 8/2010 | Weicker |
| 2008/0029240 | A1 | 2/2008 | Gerlach |
| 2009/0114364 | A1 | 5/2009 | Cieplewski |
| 2010/0173767 | A1 | 7/2010 | Koch |
| 2010/0224756 | A1 | 9/2010 | Muller |
| 2010/0294454 | A1 | 11/2010 | Muller |
| 2010/0326620 | A1 | 12/2010 | Müller |
| 2012/0196736 | A1 | 8/2012 | Bohlander |
| 2015/0129155 | A1 | 5/2015 | Koch |
| 2015/0174644 | A1 | 6/2015 | Deters |
| 2015/0246387 | A1 | 9/2015 | Bartels |
| 2015/0306658 | A1 | 10/2015 | Deters |
| 2015/0315083 | A1 | 11/2015 | Deters |

FOREIGN PATENT DOCUMENTS

| | | |
|---|---|---|
| CA | 1200655 | 2/1986 |
| DE | 102007045649 | 4/2009 |
| DE | 102012020510 | 4/2014 |
| DE | 102012020511 | 4/2014 |
| GB | 1532847 | 11/1978 |
| GB | 2045777 | 11/1980 |

OTHER PUBLICATIONS

Owusu, Y.A., "Humidity Resistance of Sodium Silicate-Bonded Sands Cured With Microwave Energy", AFS Transactions, vol. 88, 1980, pp. 601-708.

*Primary Examiner* — Kevin P Kerns
*Assistant Examiner* — Steven S Ha
(74) *Attorney, Agent, or Firm* — Standley Law Group LLP

(57) ABSTRACT

The invention relates to lithium-containing molding material mixtures comprising a refractory main molding material, an inorganic binder, and amorphous silicon dioxide as an additive in the production of molds and cores for metal casting. The invention further relates to a method for producing molds and cores using the molding material mixtures and to molds and cores produced according to the method.

24 Claims, No Drawings

LITHIUM-CONTAINING MOLDING MATERIAL MIXTURE BASED ON AN INORGANIC BINDER FOR PRODUCING MOLDS AND CORES FOR METAL CASTING

The invention relates to molding material mixtures based on inorganic binders for preparing molds and cores for metal casting, comprising at least one refractory basic molding material, one or more lithium compounds, at least water glass as inorganic binder and amorphous silica as additive. In addition the invention relates to a component system for preparing the molding material mixtures, a lithium-containing inorganic binder and a method for preparing molds and cores using the molding material mixtures and molds and cores prepared using the method.

PRIOR ART

Casting molds are essentially made of molds or molds and cores together, which represent the negative shapes of the casting to be prepared. These cores and molds consist of a refractory material, for example quartz sand, and a suitable binder, which imparts adequate mechanical strength to the casting mold after it is removed from the molding tool. The refractory basic molding material is preferably present in a free-flowing form, so that it can be filled into a suitable hollow mold and compacted therein. The binder creates solid cohesion between the particles of the basic molding material, so that the casting mold achieves the required mechanical stability.

Casting molds must fulfill various requirements. First, during the actual casting process, they must exhibit sufficient strength and temperature resistance to be able to receive the liquid metal into the cavity formed by one or more (partial) casting molds. After the solidification process begins, the mechanical stability of the casting is guaranteed by a solidified metal layer that forms along the wall of the casting mold.

The material of the casting mold must now break down under the influence of the heat released by the metal so that it loses its mechanical strength, thus eliminated the cohesion between individual particles of the refractory material is. Ideally, the casting mold breaks down again to fine sand, which can be effortlessly removed from the casting.

Since casting molds are subject to very high thermal and mechanical stresses during the casting process, defects can form at the contact surface between the liquid metal and the casting mold. Defects are formed, for example, because the casting mold cracks or because liquid metal penetrates into the microstructure of the casting mold. Usually, therefore, the surfaces of the casting mold that come into contact with the liquid metal are provided with a protective coating, also known as a core wash.

Thus by means of these coatings, the surface of the casting mold can be modified and adapted to the properties of the metal to be processed. For example, the core wash can improve the appearance of the casting by preparing a smooth surface, since the core wash smoothes out irregularities caused by the particle size of the molding material. In iron and steel casting, sometimes defects form on the surface of the casting, for example, a pitted, rough or mineralized surface, chips, dimples, or pinholes, or white or black coatings form.

If the above-described defects occur, elaborate post-processing of the surface of the casting is necessary to achieve the desired surface properties. This requires additional working steps and thus will result in decreases productivity or increased costs. If the defects appear on surfaces of the casting that are poorly accessible or even completely inaccessible, this can also lead to loss of the casting.

In addition, the core wash can affect the casting metallurgically, in that for example additives are transferred into the casting selectively at the surface of the casting via the core wash, improving the surface properties of the casting.

In addition the core washes form a layer that chemically isolates the casting mold from the liquid metal during casting. In this way, any adhesion between the casting and the casting mold is prevented, so that the casting can be removed from the casting mold without difficulty. However, the core wash can also be used to control the heat transfer between liquid metal and casting mold systematically, for example in order to achieve the development of a certain metal microstructure via the cooling rate.

A core wash usually consists of an inorganic refractory material and a binder, dissolved or suspended in a suitable solvent, for example water or alcohol. When possible, the use of alcohol-containing core washes should be avoided, and instead, aqueous systems should be used, since the organic solvents cause emissions during the drying process.

Both organic and inorganic binders can be used for preparing molds, and in each case they can be cured using cold or hot methods. A cold method is the name applied to methods of this type that are essentially performed without heating the molding tools used for core preparation, generally at room temperature or at any temperature caused by a reaction that takes place. Curing is accomplished, for example, by passing a gas through the molding material mixture to be cured and thus triggering a chemical reaction. In hot methods, the molding material mixture, after molding, is heated, e.g., by the hot molding tool, to a temperature high enough to expel the solvent contained in the binder and/or to initiate a chemical reaction that cures the binder.

Because of their technical characteristics, organic binders currently have greater significance on the market. However, regardless of their composition, they have the drawback that they decompose during casting and in the process, emit sometimes considerable quantities of harmful materials such as benzene, toluene and xylene. In addition, casting with organic binders generally leads to odor and fumes nuisances. In some systems, undesirable emissions even form during the preparation and/or storage of the casting molds. Even though over the years it has been possible to reduce the emissions, they cannot be avoided completely with organic binders.

For this reason, in recent years research and development activity has again turned toward inorganic binders in order to further improve these and the product properties of the molds and cores prepared using them.

Inorganic binders have long been known, especially those based on water glasses. They found broadest use in the 50s and 60s of the $20^{th}$ century, but with the emergence of the modern organic binders they quickly lost significance. Three different methods are available for curing the water glasses:

- Passing a gas, e.g., $CO_2$, air or a combination of the two, through the binder
- Addition of liquid or solid curing agents, e.g., esters, and
- Thermal curing, e.g., in the Hot Box-method or by microwave treatment.

Thermal curing of water glass is discussed, e.g., in U.S. Pat. No. 5,474,606, in which a binder system consisting of alkali water glass and aluminum silicate is described.

However, the use of inorganic binder systems is often associated with other drawbacks, as will be described in detail in the remarks that follow.

One drawback of inorganic binders is that the casting molds prepared from them have relatively low strengths. This is particularly apparent immediately after removal of the casting mold from the tool. The strengths at this time, which are also known as hot strengths, are particularly important for the preparation of complicated and/or thin-walled molded articles and the safe handling thereof. However, the cold strength, i.e., the strength after complete curing of the casting mold, is also an important criterion in order for the desired casting to be prepared with the required dimensional accuracy.

In addition, the relatively high viscosity of inorganic binders compared with organic binders has disadvantageous effects on their use in the automated mass preparation of cast parts.

Since higher viscosity is accompanied by reduced fluidity of the molding material mixture, delicate hollow molds, such as those required, e.g., for preparing complicated and/or thin-walled molded parts, cannot be compacted adequately.

A further important drawback of inorganic binders is their relatively low shelf life in the presence of high humidity. The atmospheric humidity is expressed as a percentage at a given temperature by the relative humidity, or in $g/m^3$ by the absolute atmospheric humidity. The shelf life of casting molds prepared by hot curing and using inorganic binders decreases distinctly, especially at an absolute atmospheric humidity of 10 $g/m^3$, which is noticeable through a distinct decrease in the strengths of casting molds, especially those prepared by hot curing, during storage. This effect, especially in the case of hot curing, is attributable to a back-reaction of polycondensation with water from the air, leading to softening of the binder bridges.

The decrease in strength under such storage conditions is sometimes associated with the appearance of so-called storage cracks. The decrease in strength weakens the microstructure of the casting mold, which at some points, in areas of high mechanical stress, can lead to easy breakage of the casting mold.

In addition to the shelf life at elevated atmospheric humidity, cores hot-cured by using an inorganic binder have low resistance, compared with organic binders, toward water-based molding material coatings such as core washes. In other words, their strengths are greatly reduced by coating, e.g., with an aqueous core wash, and this method can only be implemented in practice with great difficulty.

EP 1802409 B1 discloses that higher strengths and improved shelf life can be achieved by the use of a refractory basic molding material, a water glass-based binder and a fraction of particulate amorphous silica. As curing methods here, especially hot curing is described in greater detail. Another possibility for increasing shelf life is the use of organosilicon compounds, as explained, for example, in U.S. Pat. No. 6,017,978.

As Owusu reports, the shelf life of inorganic binders especially presents a problem in the case of hot curing, whereas casting molds cured with $CO_2$ are distinctly more resistant toward elevated atmospheric humidity (Owusu, AFS Transactions, Vol. 88, 1980, p. 601-608). Owusu discloses that the shelf life can be increased by the addition of inorganic additives such as $Li_2CO_3$ or $ZnCO_3$. Owusu assumes that the low solubility of these additives and the high hydration numbers of the cations contained have a positive effect on the stability of the silicate gel and thus on the shelf life of the water glass binder. However, improving the shelf life by changing the composition of the liquid inorganic binder is not investigated in this publication.

Improving the moisture resistance of water glass binders is described in DE 2652421 A1 and U.S. Pat. No. 4,347,890. DE 2652421 A1 especially addresses various methods for preparing lithium-containing binders based on aqueous alkali silicate solutions. The binders described in DE 2652421 A1 are characterized by a $Na_2O$ and/or $K_2O$:$Li_2O$:$SiO_2$ weight ratio in the range of 0.80-0.99:0.01-0.20:2.5-4.5, which corresponds to a $Li_2O/M_2O$ material amount ratio of 0.02-0.44 and a $SiO_2/M_2O$ molar ratio of 1.8-8.5. Here, $[M_2O]$ designates the sum of the quantities of material of the alkali oxides. The binders described here have improved water resistance, i.e., they have less of a tendency to absorb water from the atmosphere, as was demonstrated by gravimetric investigations. Although the manufacturing of casting molds is listed as a possible application, no statements are made about the strengths of the prepared molds, much less their shelf life.

U.S. Pat. No. 4,347,890 describes a method for preparing an inorganic binder consisting of an aqueous sodium silicate solution and a solution of a lithium compound, with lithium hydroxide and lithium silicate being especially preferred. The lithium compound is added to increase the moisture stability of the binder. The alkali silicate binder according to U.S. Pat. No. 4,347,890 contains a $Li_2O/M_2O$ ($M_2O=Li_2O+Na_2O$) substance mixture amount of 0.05-0.44.

Problems of the Prior Art and Statement of the Problem

The inorganic binder systems for use in foundries known to date still have room for improvement. First and foremost it is desirable to develop an inorganic binder system which:

a) makes possible the preparation of casting molds that are stable during storage even at elevated atmospheric humidity. An adequate shelf life is especially desirable to allow storage of molds for longer time periods after they are prepared and thus to extend the processing window of the manufacturing process.

b) achieves an appropriate moisture level as needed in the automated manufacturing process, in particular adequate hot strength or cold strength.

c) with a basic molding material, provides a molding material mixture of good fluidity, so that casting molds with complex geometry can also be obtained. Since the fluidity of the molding material mixture depends directly on the viscosity of the binder, said viscosity must at least be reduced insofar as possible.

d) allows for the preparation of casting molds with improved stability of the prepared cores compared with molding material coatings having a water content in the vehicle of at least 50 wt. % The vehicle is the constituent of the mold material coating that can be evaporated at 160° C. and normal pressure (1013 mbar). Since such water-based molding material coatings are preferable from the environmental aspect and for reasons of occupational safety, it is desirable also to use them for casting molds that were prepared with inorganic binders.

e) is associated with low costs for the foundries, since the binder is only intended for a single use. In particular, the lithium fraction in the binder must be selected to be low, since the costs of lithium compounds have increased considerably recently because of the increased demand.

Therefore the invention was based on the goal of providing a molding material mixture of a binder for preparing casting molds for metal processing, which would meet the above-mentioned requirements (a) to (e).

SUMMARY OF THE INVENTION

This goal is achieved by the molding material mixtures, binders and method for preparing casting molds and cores with the features of the respective independent claims. Advantageous further developments form the subject matter of the patent subclaims or will be described in the following.

Surprisingly it was found that through the use of a lithium-containing molding material mixture based on an inorganic binder which has a defined quantitative composition ratio $[Li_2O_{active}]/[M_2O]$ (M=alkali metal) and a defined molar ratio $[SiO_2]/[M_2O]$ in each case according to the following definition, the above-described tasks can be accomplished distinctly more effectively.

In particular, the molding material mixture according to the invention is characterized by the fact that the casting molds prepared from it have an increased shelf life along with a high level of strength. At the same time, the casting molds prepared with the molding material mixture according to the invention are more stable compared with water-based molding material coatings, i.e., molding material coatings having a water content in the vehicle of at least 50 wt. %. These positive characteristics are accompanied by lower viscosity of the binder and thus improved fluidity of the molding material mixture according to the invention. It is surprising that these advantages can only be achieved if the $[Li_2O_{active}]/[M_2O]$ molar ratio and the $[SiO_2]/[M_2O]$ molar ratio fall within certain well-defined limits and at the same time, amorphous particulate silica is added to the molding material mixture.

Compared with the prior art, the molding material mixtures according to the inventions make it possible for foundries to prepare casting molds with an adequate shelf life and increased stability as against water-based molding material coatings, without having to allow for drawbacks in terms of their strengths or the fluidity der molding material mixture.

The molding material mixture according to the invention has:

a refractory basic molding material; and
particulate amorphous $SiO_2$ and
water glass as an inorganic binder
one or more lithium compounds, where the $[Li_2O_{active}]/[M_2O]$ molar ratio in the molding material amounts to from 0.030 to 0.17, preferably 0.035 to 0.16 and particularly preferably 0.040 to 0.14, and the $[SiO_2]/[M_2O]$ molar ratio amounts to 1.9 to 2.47, preferably 1.95 to 2.40 and particularly preferably 2 to 2.30.

According to the present invention, $[SiO_2]$, $[M_2O]$ and $[Li_2O_{active}]$ always have the following meanings:

$[M_2O]$ the amount of substance in mol of alkali metal M, calculated as $M_2O$, where ultimately only the following compounds enter into the calculation: amorphous alkali silicates, alkali metal oxides and alkali metal hydroxides, including the hydrates thereof, where Li enters into the calculation as part of M without an activity factor, $[Li_2O_{active}]$ the amount of substance in mol of Li, calculated as $Li_2O$, where ultimately only the following compounds enter into the calculation: amorphous lithium silicates, lithium oxides and lithium hydroxide, including the hydrates thereof, according to the diagram that follows with consideration of activity factors.

$[SiO_2]$ is the amount of substance in mol of Si, calculated as $SiO_2$, where ultimately only the following compounds enter into the calculation: amorphous alkali silicates, According to one embodiment, the molding material mixture according to the invention for preparing casting molds for metal processing can preferably be prepared by bringing together at least the following three components, initially separate from one another:

Component (F) comprises a refractory basic molding material and no water glass;

Component (B) comprises a water glass as inorganic binder and no added particulate amorphous $SiO_2$;

Component (A) comprises particulate amorphous $SiO_2$ as the additive component and optionally one or more lithium compounds as solids and no water glass.

Component (A) is called the additive. According to this embodiment of the invention, component (B), including component (A), has a $[Li_2O_{active}]/[M_2O]$ molar ratio of 0.030 to 0.17, preferably 0.035 to 0.16 and particularly preferably 0.040 to 0.14 and a $[SiO_2]/[M_2O]$ molar ratio of 1.9 to 2.47, preferably 1.95 to 2.40 and particularly preferably of 2 to 2.30 auf.

Surprisingly it was found that the activity of the lithium compounds in the invention depends on the way in which the lithium compounds used are added, and thus the above-named compounds have different activities. This fact is taken into consideration by defining an active content $[Li_2O_{active}]$, which defines the lithium content beyond the definition of the active compounds, using the activity factors defined as follows (scheme):

$[Li_2O_{active}]$=1*amorphous lithium silicates, which are added via the component inorganic binder (B), calculated as mol $Li_2O$, +

1*lithium oxide, which is added via the component inorganic binder (B), calculated as mol $Li_2O$, +

1*lithium hydroxide, which is added via the component inorganic binder (B), calculated as mol $Li_2O$+

0.33*amorphous lithium silicates, which are not added via the binder (B), calculated as mol $Li_2O$, +

0.33*lithium oxide, which is not added via the inorganic binder (B), calculated as mol $Li_2O$, +

0.33*lithium hydroxide, which is not added via the binder (B), calculated as mol $Li_2O$ (*=multiplied), including the hydrates thereof. In each case 0.33 or 1 is the (molar) activity factor.

The above definitions for $[M_2O]$, $[SiO_2]$ and $[Li_2O_{active}]$ apply for all embodiments and categories of the present invention, including, e.g., the definition for $[K_2O]/[M_2O]$.

Surprisingly it was found that based on the calculated molar $[Li_2O]$ content three times as much (molar) amorphous lithium silicates, lithium oxide or lithium hydroxide must be used if these compounds are added via the additive component, compared with the molar amount of amorphous lithium silicate, lithium oxide or lithium hydroxide added via the inorganic binder (B) component, in which they are generally/preferably dissolved.

Particularly preferably the lithium compound(s) is/are dissolved completely in the inorganic binder (B) component. Such a component (B) contains water glass as the inorganic binder and has a $[SiO_2]/[M_2O]$ molar ratio of 1.9 to 2.47, preferably 1.95 to 2.40 and particularly preferably of 2 to 2.30 auf and a $[Li_2O_{active}]/[M_2O]$ molar ratio of 0.030 to 0.17, preferably 0.035 to 0.16 and particularly preferably 0.040 to 0.14.

The additive component consists of one or more solids, especially in the form of a free-flowing powder. Preferably all lithium compounds that contribute to the [$Li_2O_{active}$] content are present in component B.

DETAILED DESCRIPTION OF THE INVENTION

The usual materials for preparing casting molds can be used as the refractory basic molding material (called basic molding material(s) for short in the following). For example, quartz, zirconia or chromia sand, olivine, vermiculite, bauxite and fire clay are suitable. It is not necessary to use exclusively new sand. In order to conserve resources and avoid disposal costs it is advantageous to use the highest possible amount of regenerated old sand.

For example, a suitable sand is described in WO 2008/101668 A1 (=US 2010/173767 A1). Also suitable are regenerated materials obtained by washing and then drying. Regenerated materials obtained by purely mechanical treatment can also be used. As a rule, the regenerated materials can replace at least 70 wt. % of the new sand, preferably at least about 80 wt. % and particularly preferably at least about 90 wt. %.

The mean diameter of the basic molding materials is generally between 100 μm and 600 μm, preferably between 120 μm and 550 μm and particularly preferably between 150 μm and 500 μm. The particle size can be determined, e.g., by sieving according to DIN 66165 (Part 2).

In addition, artificial molding materials can also be used as basic molding materials, especially as additives to the above basic molding materials but also as the exclusive basic molding material, e.g., glass beads, glass frits, the spherical ceramic basic molding materials known under the name of "Cerabeads" or "Carboaccucast" or aluminum silicate microspheres. These aluminum silicate microspheres are sold, for example, by Omega Minerals Germany GmbH, Norderstedt, under the name of "Omega-Spheres." Similar products are also available from the PQ Corporation (USA) under the name of "Extendospheres."

It was found in casting experiments with aluminum that when artificial basic molding materials are used, especially glass beads, glass frits or microspheres, less molding sand remains adhering to the metal surface after casting than in when quartz sand is used. The use of artificial basic molding materials therefore allows for the preparation of smoother casting surfaces, with which complicated after-treatment by media blasting is not required, or at least is required only to a considerably lesser extent.

In this connection it is not necessary to prepare all of the basic molding materials from the artificial basic molding materials. The preferred fraction of the artificial basic molding materials is at least about 3 wt. %, particularly preferably at least about 5 wt. %, especially preferably at least about 10 wt. %, preferably at least about 15 wt. %, particularly preferably at least about 20 wt. %, in each case based on the total amount of the refractory basic molding material.

As an additional constituent, the molding material mixture according to the invention has an inorganic binder based on alkali silicate solutions. Aqueous solutions of alkali silicates, especially lithium, sodium and potassium silicates, which are also called water glass, are also used as binders in other areas, e.g., in construction.

The preparation of water glass is performed, e.g., on a large industrial scale by melting quartz sand and alkali carbonates at temperatures of 1350° C. to 1500° C. The water glass is initially obtained in the form of solid glass fragments, which is dissolved in water under the influence of temperature and pressure. An additional method for preparing water glasses is the direct dissolution of quartz sand with sodium hydroxide.

The alkali silicate solution obtained can then be adjusted to the desired [$SiO_2$]/[$M_2O$] molar ratio by addition of alkali hydroxides and/or alkali oxides as well as the hydrates thereof. In addition, the composition of the alkali silicate solution can be adjusted by dissolving alkali silicates with a different composition. In addition to alkali silicate solutions, solid hydrated alkali silicates may also be used, e.g., the product groups Kasolv, Britesil or Pyramid from PQ Corporation.

The binders can also be based on water glasses that contain more than one of the alkali ions mentioned. In addition, the water glasses can also contain polyvalent ions such as boron or aluminum (corresponding water glasses are described, e.g., in EP 2305603 A1 (=US 2012/196736 A1)).

The lithium-containing binder or the lithium-containing molding material mixture is prepared by adding a lithium compound, namely amorphous lithium silicate, $Li_2O$ and/or LiOH to an inorganic binder. Amorphous lithium silicate, $Li_2O$ and LiOH here also include the hydrates thereof. The lithium compound can also be added in powder form or in an aqueous solution or suspension. In a preferred embodiment the lithium-containing binder is a homogeneous solution of the above described lithium compounds in the binder according to the invention.

In addition, the addition of the lithium compound to the molding material mixture may also take place exclusively via component (A), the additive, but it is preferred to add the lithium compound at least partially, preferably exclusively, via component (B), the inorganic binder.

Surprisingly it was found that using the molding material mixture according to the invention, casting molds with distinctly improved shelf life as well as increased stability compared with water-based molding material coatings and still high immediate strengths and cold strengths, as needed for automated mass preparation, can be prepared. Furthermore, component (B), the inorganic binder, according to the invention is characterized by low viscosity and thus high fluidity of the molding material mixture prepared with it, compared to the prior art.

However, the effect according to the invention was only observed if both the [$Li_2O_{active}$]/[$M_2O$] molar ratio and the [$SiO_2$]/[$M_2O$] molar ratio fall within certain limits and the above-named lithium compounds are used. The positive effect of the lithium, even at low concentrations, on the moisture stability of casting molds prepared from the molding material mixture according to the invention has not been explained. Without being tied to this theory, the inventors believe that the small ionic radius of $Li^+$ with the same charge has a stabilizing effect on the silicate structure.

As is usual for inorganic binders based on alkali silicates, the composition of the inorganic binder component according to the invention is specified in terms of the fractions of $SiO_2$, $K_2O$, $Na_2O$, $Li_2O$ and $H_2O$.

The quantitative ratio [$Li_2O_{active}$]/[$M_2O$] of the molding material mixture, the inorganic binder and additive components or the inorganic binder alone is greater than or equal to 0.030, preferably greater than or equal to 0.035 and particularly preferably greater than or equal to 0.040. The upper limits lie at less than or equal to 0.17, preferably less than or equal to 0.16 and particularly preferably less than or equal to 0.14. The aforementioned upper and lower limit values may be combined as desired.

At the same time, the $[SiO_2]/[M_2O]$ molar ratio of the molding material mixture, the inorganic binder component and additive or the inorganic binder alone is greater than or equal to 1.9, preferably greater than or equal to 1.95 and particularly preferably greater than or equal to 2.

The upper limit for the $[SiO_2]/[M_2O]$ molar ratio is less than or equal to 2.47, preferably less than or equal to 2.40 and particularly preferably less than or equal to 2.30. Preferred upper and lower limit values may be combined as desired.

The inorganic binders preferably have a solids fraction of greater than or equal to 20 wt. %, preferably greater than or equal to 25 wt. %, particularly preferably greater than or equal to 30 wt. % and especially preferably greater than or equal to 33 wt. %. The upper limits for the solids content of the preferred water glasses are less than or equal to 55 wt. %, preferably less than or equal to 50 wt. %, particularly preferably less than or equal to 45 wt. % and especially preferably less than or equal to 42 wt. %. The solids fraction is defined here as the weight fraction of $M_2O$ and $SiO_2$.

In a preferred embodiment the inorganic binder according to the invention contains amorphous lithium silicate as well as sodium and potassium silicates. Potassium-containing water glasses have lower viscosities compared with pure sodium water glass or mixed lithium-sodium water glasses. The mixed lithium-sodium-potassium water glasses particularly preferred according to the invention thus combine the advantage of increased moisture stability with a simultaneously high moisture level and a further lowering of the viscosity. Low viscosity values are especially indispensable for automated mass preparation in order to guarantee good fluidity of the molding material mixture and thus to make even complex core geometries possible. The potassium content of the inorganic binder according to the invention, however, may not be too high, since excessively high potassium content will negatively affect the shelf life of the prepared casting molds.

Preferably the $[K_2O]/[M_2O]$ molar ratio in the inorganic binder, especially in component B, is greater than 0.03, particularly preferably greater than 0.06 and especially preferably greater than 0.1. For the upper limit of the quantitative ratio $[K_2O]/[M_2O]$ a value of less than or equal to 0.25, preferably less than or equal to 0.2 and particularly preferably less than or equal to 0.15 is obtained. The above-named upper and lower limit values can be combined as desired. Finally the following compounds are introduced into the calculation of $[K_2O]$: amorphous potassium silicates, potassium oxides and potassium hydroxides, including the hydrates thereof.

Depending on the use and desired strength level, more than 0.5 wt. %, preferably more than 0.75 wt. % and particularly preferably more than 1 wt. % of the binder according to the invention is used. The upper limits are less than 5 wt. %, preferably less than 4 wt. % and particularly preferably less than 3.5 wt. %. These statements each case relate to the basic molding material. The wt. % information relates to the inorganic binder with a solids fraction as indicated above, i.e., the wt. % information includes the diluent.

Based on the amount of alkali silicates, calculated as $M_2O$ and $SiO_2$, added to the basic molding material with the inorganic binder according to the invention, without consideration of the diluent, the amount of the binder used is 0.2 to 2.5 wt. %, preferably 0.3 to 2 wt. % relative to the basic molding material, where $M_2O$ has the meaning stated above.

In an additional embodiment the binder according to the invention can additionally contain alkali borates. Alkali borates as constituents of water glass binders are disclosed, e.g., in GB 1566417, where they are used for complexation of carbohydrates. Typical added quantities of the alkali borates are from 0.5 wt. % to 5 wt. %, preferably between 1 wt. % and 4 wt. % and particularly preferably between 1 wt. % and 3 wt. %, based on the weight of the binder.

A fraction of particulate amorphous $SiO_2$ in the form of the additive component is added to the molding material mixture according to the invention to increase the strength level of the casting molds prepared with such molding material mixtures. An increase in the strengths of the casting molds, especially the increase in their hot strengths, can be advantageous in the automated manufacturing process. The particulate amorphous silica has a particle size preferably of less than 300 μm, preferably less than 200 μm, especially preferably less than 100 μm. The particle size can be determined by sieve analysis. The screen residue of the particulate amorphous $SiO_2$ for passage through a screen with 125 μm mesh size (120 mesh) preferably amounts to no more than 10 wt. %, particularly preferably no more than 5 wt. % and very particularly preferably no more than 2 wt. %.

The screen residue is determined using the machine sieving method described in DIN 66165 (Part 2), where in addition a chain ring is used as sieving aid.

The amorphous $SiO_2$ preferably used according to the present invention has a water content of less than 15 wt. %, especially less than 5 wt. % and particularly preferably of less than 1 wt. %. In particular, the amorphous $SiO_2$ is used as a free-flowing powder.

Synthetically prepared and naturally occurring silicas can be used as the amorphous $SiO_2$. However, the latter, known, e.g., from DE 102007045649, are not preferred, since they generally contain considerable fractions of crystalline material and therefore are classified as carcinogenic.

The term synthetic is defined as not naturally occurring amorphous $SiO_2$, but their preparation comprises a (human-initiated) chemical reaction, e.g., the preparation of silica sols by ion exchange processes from alkali silicate solutions, precipitation from alkali silicate solutions, flame hydrolysis of silicon tetrachloride or the reduction of quartz sand with coke in an electric arc furnace in the preparation ferrosilicon and silicon. The amorphous $SiO_2$ prepared by the last-named method is also known as pyrogenic $SiO_2$.

Occasionally, synthetic amorphous $SiO_2$ is only construed to include precipitated silica (CAS-Nr. 112926-00-8) and $SiO_2$ prepared by flame hydrolysis (Pyrogenic Silica, Fumed Silica, CAS-Nr. 112945-52-5), whereas the product prepared during the manufacture of ferrosilicon or silicon is merely called amorphous $SiO_2$ (Silica Fume, Microsilica, CAS-Nr. 69012-64-12). For the purposes of the present invention the product prepared during the manufacturing of ferrosilicon or silicon is designated as synthetic amorphous $SiO_2$.

The preferred materials for use are precipitated silica and pyrogenic $SiO_2$, i.e., that prepared by flame hydrolysis or in an electric arc furnace. Particularly preferably used are $SiO_2$ prepared by thermal decomposition of $ZrSiO_4$ (see DE 102012020509) and $SiO_2$ prepared by oxidation of metallic Si using an oxygen-containing gas (see DE 102012020510).

Also preferred is quartz glass powder (mainly amorphous $SiO_2$), which was prepared from crystalline quartz by melting and rapid cooling, so that the particles are spherical and not splintered (see DE 102012020511). The average primary particle size of the synthetic amorphous silica can amount to between 0.05 μm and 10 μm, especially between 0.1 μm and 5 μm and particularly preferably between 0.1 μm and 2 μm.

The primary particle size can be determined, e.g., by dynamic light scattering (for example Horiba LA 950) or by scanning electron microscopy (SEM imaging with, e.g., Nova NanoSEM 230 from the FEI company). To avoid agglomeration of particles, prior to particle size measurement the samples are dispersed in water in an ultrasonic bath. In addition, using the SEM photographs, details of the primary particle shape down to the order of magnitude of 0.01 μm can be visualized. For the SEM measurements the $SiO_2$ were dispersed in distilled water and then applied to an aluminum holder with a copper strip attached before the water was evaporated.

Preferably the average primary particle size is between 0.05 μm and 10 μm, measured by dynamic light scattering (for example Horiba LA 950) and optionally checked by scanning electron microscopic photography.

In addition, the specific surface area of the synthetic amorphous silica was determined using gas adsorption measurements (BET method) according to DIN 66131. The specific surface area of the synthetic amorphous $SiO_2$ is preferably between 1 and 35 $m^2/g$, preferably between 1 and 17 $m^2/g$ and especially preferably between 1 and 15 $m^2/g$. Optionally, the products can also be mixed, e.g., to obtain targeted mixtures with certain particle size distributions.

The purity of the amorphous $SiO_2$ can vary greatly depending on the preparation method and manufacturer. Types with $SiO_2$ content of at least 85 wt. %, preferably at least 90 wt. % and particularly preferably at least 95 wt. % have proven suitable.

Depending on the application and the desired strength level, between 0.1 wt. % and 2 wt. % of the particulate amorphous $SiO_2$ are used, preferably between 0.1 wt. % and 1.8 wt. %, particularly preferably between 0.1 wt. % and 1.5 wt. %, in each case based on the basic molding material.

The ratio of water glass to particulate metal oxide and especially amorphous $SiO_2$ can be varied within broad limits. This offers the advantage of greatly improving the initial strengths of the cores, i.e., the strength immediately after removal from the tool, without a substantial effect on the final strength. This is principally of great interest in light metal casting. On one hand, high initial strengths are desired so that after they are prepared, the cores can be transported without problems or combined into complete core packages, and on the other hand the final strengths should not be too high in order to avoid problems in the core disintegration after casting, i.e., after casting it should be possible to remove the basic molding material from the cavities of the casting mold without problems.

Based on the weight of the binder (including diluent or solvent) the particulate amorphous $SiO_2$ is preferably present in the molding material mixture in a fraction of 2 to 60 wt. %, particularly preferably of 3 to 55 wt. % and especially preferably between 4 and 50 wt. %.

The addition of the amorphous $SiO_2$ can be performed according to EP 1802409 B1 both before and after the binder addition, directly to the refractory material, but alternatively, as described in EP 1884300 A1 (=US 2008/029240 A1) first a premix of the $SiO_2$ with at least part of the binder or sodium hydroxide solution can be prepared and this then mixed into the refractory solid. The binder or binder fraction that is still present and was not used for the premix can be added to the refractory material before or addition of the premix or together with it.

In an additional embodiment the additive component barium sulfate can be added to further improve the surface area of the casting, especially in light metal casting, such as aluminum casting. The barium sulfate can be synthetically prepared and/or natural barium sulfate, i.e., added in the form of minerals containing barium sulfate such as heavy spar or barite.

This and other features of the suitable barium sulfate as well as the molding material mixture prepared with it are described in further detail in DE 102012104934, the disclosure content of which is incorporated by reference into the disclosure of the present intellectual property insofar as applicable.

In an additional embodiment, the additive component of the molding material mixture according to the invention can also comprise at least aluminum oxides and/or aluminum/silicon mixed oxides in particulate form or metal oxides of aluminum and zirconium in particulate form, as described in greater detail in DE 102012113073 or DE 102012113074—insofar as the additives disclosed there are also considered as constituents of the present intellectual property disclosure. Using additives of this type, castings, especially made of iron or steel, with very high surface quality can be obtained after metal casting, so that after removal of the casting mold, little or no post-processing of the surface of the casting is required.

In an additional embodiment, the additive component of the molding material mixture according to the invention can comprise a phosphorus-containing compound. An additive of this type is preferred in the case of very thin-walled sections of a casting mold and especially in the case of cores, since in this way the thermal stability of the cores or the thin-walled section of the casting mold can be increased. This is especially significant if the liquid metal impacts upon an oblique surface during casting and causes a pronounced erosion effect there because of the high metallostatic pressure or can lead to deformations of especially thin-walled sections of the casting mold. Suitable phosphorus compounds have little or no effect on the processing time of the molding material mixtures according to the invention. Suitable representatives and their addition quantities are described in detail in WO 2008/046653 A1 and these are therefore also made part of the disclosure of the present intellectual property.

The preferred fraction of the phosphorus-containing compound, based on the basic molding material, is between 0.05 and 1.0 wt. % and preferably between 0.1 and 0.5 wt. %.

In an additional embodiment the molding material mixture according to the invention may be added with the organic compounds additive component (according to EP 1802409B1 and WO2008/046651). A small added amount of organic compounds can be advantageous for special applications—for example, to regulate the thermal expansion of the cured molding material mixture. However, such an addition is not preferred, since it is again associated with emissions of $CO_2$ and other pyrolysis products.

Water-containing binders generally have inferior fluidity compared with binders based on organic solvents. This means that molding tools with narrow passages and multiple changes of direction are more difficult to fill. In consequence, the cores may have sections with inadequate compaction, which can again result in casting defects during casting. According to an advantageous embodiment the additive component of the molding material mixture according to the invention contains a fraction of foliated lubricants, especially graphite or $MoS_2$. Surprisingly it has been found that when such lubricants, especially graphite, are added, even complex molds with thin-walled sections can be prepared, where the casting molds uniformly exhibit high density and strength, so that essentially no casting defects were seen during casting. The amount of added foliated lubricants, especially graphite, preferably amounts to 0.05 to 1 wt. %, particularly preferably 0.05 to 0.5 wt. %, based on the basic molding material.

Instead of or in addition to the foliated lubricants, surface-active substances, especially surfactants, can also be used in the inorganic binder component to further improve the fluidity of the molding material mixture according to the invention. Suitable representatives of these compounds are described, for example, in WO 2009/056320 A1 (=US 2010/0326620 A1). Especially surfactants with sulfuric acid or sulfonic acid groups should be mentioned in this connection. Additional suitable representatives and the respective quantities to be added are described in detail in WO 2009/056320 A1, and therefore this is also made part of the disclosure of the present intellectual property.

In addition to the constituents mentioned, the molding material mixture according to the invention may comprise additional additives. For example, release agents may be added to facilitate the removal of the cores from the molding tool. Suitable release agents are, e.g., calcium stearate, fatty acid esters, waxes, natural resins or special alkyd resins. Insofar as these release agents are soluble in the binder and do not separate from this even after prolonged storage, especially at low temperatures, they can already be present in the binder component, but they may also be part of the additive.

In addition, silanes can also be added to the molding material mixture according to the invention, for example to further increase the storage stability of the cores or their resistance to water-based molding material coatings. According to a further preferred embodiment, the molding material mixture according to the invention therefore contains a fraction of at least one silane. Silanes that may be used, for example, include aminosilanes, epoxysilanes, mercaptosilanes, hydroxysilanes and ureidosilanes. Examples of silanes of this type are γ-aminopropyl-trimethoxysilane, γ-hydroxypropyl-trimethoxysilane, 3-ureidopropyl-trimethoxysilane, γ-mercaptopropyl-trimethoxysilane, γ-glycidoxypropyl-trimethoxysilane, β-(3,4-epoxycyclohexyl)-trimethoxysilane, N-β-(aminoethyl)-γ-aminopropyl-trimethoxysilane and the triethoxy-analogous compounds thereof. The silanes mentioned, especially the aminosilanes, can also be pre-hydrolyzed. Based on the binder, about 0.1 wt. % to 2 wt. % of silane are typically used, preferably approx. 0.1 wt. % to 1 wt. %.

If the die molding material mixture contains silanes, it is usually added in the form such that they are incorporated in the binder in advance. However, they can also be added to the molding material.

In the preparation of the molding material mixture, the refractory basic molding material is placed in a mixer and then first the liquid component is added and mixed with the refractory basic molding material until a uniform layer of the binder has formed a uniform layer of the binder on the particles of the refractory basic molding material.

The mixing duration is selected such that intimate mixing of refractory basic molding material and liquid component takes place. The mixing duration depends on the amount of the molding material mixture to be prepared and the mixing unit used. The mixing time is preferably selected between 1 and 5 minutes. Preferably with further agitation of the mixture, the solid component(s) in the form of amorphous silica and optionally additional powdered solids are then added and the mixing continued. Here also the mixing time depends on the amount of molding material mixture to be prepared and the mixing apparatus used. The mixing time is preferably selected between 1 and 5 minutes. A liquid component may be a mixture of various liquid components or the totality of all individual liquid components, where the latter may be added to the molding material mixture jointly or successively. In practice it has proven effective first to add the (other) solid components to the refractory basic molding material, mix them, and only then introduce the liquid component(s) to the mixture, followed by mixing again.

The molding material mixture is then brought into the desired form. The usual methods are employed for molding. For example, the molding material mixture can be shot into the molding tool using a core shooting machine with compressed air. An additional possibility consists of allowing the molding material mixture to flow freely form the mixer into the molding tool and compact it there by shaking, stamping or pressing.

The molding material mixture according to the invention can basically be cured by all curing methods known for water glasses, such as hot curing or the $CO_2$ method. A further development of the $CO_2$ method, which involves a combination of $CO_2$ and air gassing, is described in DE 102012103705.1 and also represents a suitable method for curing the molding material mixture according to the invention.

To accelerate curing, the $CO_2$ or the air or both gases may also be heated in this method, e.g., to temperatures up to 100° C.

An additional method for curing the molding material mixture according to the invention is curing using liquid (for example organic esters, triacetin etc.) or solid catalysts (for example, suitable aluminum phosphates).

An additional method for preparing the casting molds is the so-called Rapid Prototyping. This technology is especially differentiated by the fact that the molding material mixture is not pressure-compacted into the desired mold, but first the solid components such as the basic molding material and any additives are applied in layers. In the next step, the liquid component of the molding material mixture is systematically printed onto the sand-/additive mixture. Then the casting mold is prepared by curing the "printed" areas. For inorganic binders, curing in the area of Rapid Prototyping technology takes place among other things by microwave curing, by curing with a liquid or solid catalyst or by drying in an oven or in air. Additional details of Rapid Prototyping technology can be found, among other locations, in EP 0431924 B1 and U.S. Pat. No. 6,610,429 B2.

Hot curing is preferred. Here, the molding material mixture is subjected to a temperature of 100 to 300° C., preferably 120 to 250°. In hot curing, water is withdrawn from the molding material mixture. As a result, presumably, condensation reactions between silanol groups are also initiated, so that cross-linking of the water glass begins.

For example, heating can be performed in a molding tool, which preferably has a temperature of 100 to 300° C., particularly preferably 120° C. to 250° C. Preferably a gas (for example air) is passed through the molding material mixture, wherein this gas preferably has a temperature of 100 to 180° C., particularly preferably 120 to 150° C. Further details on curing the casting mold are described in detail in EP 1802409 B1, and this is also regarded as a constituent of the disclosure of the present intellectual property.

The removal of the water from the molding material mixture can also take place in that the heating of the molding material mixture is accomplished by irradiating with microwaves.

For example, the microwave irradiation can be performed after the casting mold has been removed from the molding tool. In this case, however, the casting mold must already have sufficient strength. As was previously explained, for example, this can be achieved in that at least an outer shell of the casting mold is already cured in the molding tool. In accordance with the above-described Rapid Prototyping technology, the removal of the water from the molding material mixture can likewise be accomplished in that the heating of the molding material mixture is prepared by the action of microwaves. For example, it is possible to mix the basic molding material with the solid, powdered component(s), apply this mixture in layers to a surface and print on the individual layers using a liquid binder component, especially a water glass, where in each case the layer-by-layer application of the solids mixture takes place using the liquid binder. At the end of this process, i.e., after the end of the last printing process, the entire mixture can be heated in a microwave oven.

The methods according to the invention are inherently suitable for preparing all casting molds suitable for metal casting, thus for example of cores and molds.

Despite the high strengths achievable with the molding material mixture according to the invention, the cores prepared from these molding material mixtures exhibit good disintegration after casting, so that the molding material mixture can be removed even from narrow and angulated sections of the casting after the casting process is complete. The molds prepared from the molding material mixture according to the invention are generally suitable for the casting of metals, for example light metals, nonferrous metals or ferrous metals.

An additional advantage is that the casting mold has very high stability under mechanical stress, so that even thin-walled sections of the casting mold can be realized without becoming deformed by the metallostatic pressure during the casting process. An additional object of the invention is therefore a casting mold that was obtained using the above described method according to the invention.

The invention will be explained in greater detail based on the following examples, without being limited to these.

EXAMPLES

1. Preparation of the Water Glass Binder from a Lithium Hydroxide-Solution

Tables 1, 2, 3 and 4 provide an overview of the composition of the various water glass binders according to the invention and not according to the invention that were examined within the framework of the present investigation. The water glass binders are prepared by mixing the chemicals listed in Tables 1 and 2 to prepare a homogeneous solution. They were not used until one day after they were prepared to ensure that they were homogeneous. The concentrations of the alkali oxides and $[SiO_2]$ in the water glass binders used as well as their molar ratios and the $[Li_2O_{active}]/[M_2O]$ quantitative ratios are summarized in Tables 4 and 5. Table 3 provides a summary of the molding material mixtures in which the lithium compound was added by way of the additive component. In these instances the solid lithium compound was added along with the amorphous $SiO_2$ (cf. 2.1).

2. Shelf Life Studies 2.1 Preparation of the Molding Material Mixtures 100 parts by weight (PBW) quartz sand (quartz sand H32 from Quarzwerke GmbH) were placed in the bowl of a Hobart mixer (Model HSM 10). Then 2 PBW of the binder were added while stirring, and in each case mixed intensively with the sand for 1 minute. Following addition of the binder, 0.5 PBW of amorphous $SiO_2$ were added and this was likewise mixed in for 1 Minute. The amorphous $SiO_2$ was an amorphous silicon oxide POS B-W 90 LD from Possehl Erzkontor GmbH.

2.2 Preparation of the Test Pieces

For testing the molding material mixtures, rectangular test bars with dimensions of 150 mm×22.36 mm×22.36 mm were prepared (so-called Georg Fischer bars). One part of a molding material mixture prepared according to 3.1. was transferred to the storage hopper of an H 2.5 Hot Box core shooting machine from Röperwerk-Gießereimaschinen GmbH, Viersen, DE, with its molding tool heated to 180° C.

TABLE 1

Composition of the binders used

| # | Sodium water glass binder[a] [PBW] | NaOH[b] [PBW] | LiOH•$H_2O$[c] [PBW] | DM water (additional) [PBW] |
|---|---|---|---|---|
| 1.1 | 81.63 | 3.12 | 0.40 | 14.85 |
| 1.2 | 81.75 | 2.74 | 0.81 | 14.70 |
| 1.3 | 81.88 | 2.36 | 1.21 | 14.55 |
| 1.4 | 82.07 | 1.79 | 1.82 | 14.32 |
| 1.5 | 82.26 | 1.21 | 2.44 | 14.09 |
| 1.6 | 82.42 | 0.74 | 2.94 | 13.90 |
| 1.7 | 75.02 | 6.29 | 1.44 | 17.25 |
| 1.8 | 77.34 | 4.96 | 1.36 | 16.34 |
| 1.9 | 79.82 | 3.54 | 1.28 | 15.36 |
| 1.10 | 81.88 | 2.36 | 1.21 | 14.55 |
| 1.11 | 83.35 | 1.52 | 1.16 | 13.97 |
| 1.12 | 84.79 | 0.69 | 1.12 | 13.40 |
| 1.13 | 85.98 | 0 | 1.08 | 12.94 |

[a]Sodium water glass 48/50 from BASF SE; molar ratio $[SiO_2]/[M_2O]$ approx. 2.82; solids content approx. 45.5%

[b]Sodium hydroxide flakes (Sigma-Aldrich)

[c]Lithium hydroxi6de monohydrate (solid; supplier: Lomberg GmbH)

DM = demineralized,

PBW = parts by weight (100 PBW = total binder, incl. diluent water)

TABLE 2

Composition of binders used

| # | Sodium water glass binder[a] [PBW] | Potassium water glass binder[b] [PBW] | NaOH[c] [PBW] | LiOH•$H_2O$[d] [PBW] | DM water (additional) [PBW] |
|---|---|---|---|---|---|
| 2.1 | 64.4 | 16.1 | 3,.1 | 0 | 16.4 |
| 2.2 | 64.4 | 16.1 | 2.0 | 1.2 | 16.3 |
| 2.3 | 64.4 | 16.1 | 0.9 | 2.3 | 16.3 |

[a]Sodium water glass 47/48 from BASF SE; $[SiO_2]/[M_2O]$ molar ratio approx. 2.68; solids content approx. 43.5%

[b]Potassium water glass 35 from BASF SE; $[SiO_2]/[M_2O]$ molar ratio approx. 3.45, solids content approx. 34.8%

[c]Sodium hydroxide flakes (Sigma-Aldrich)

[d]Lithium hydroxide monohydrate (solid; supplier: Lomberg GmbH)

TABLE 3

| Composition of the binder and additive components used[a] | | | | | |
|---|---|---|---|---|---|
| | Composition of the water glass binders, which was already prepared prior to the experiment | | | Solid sodium and lithium compound added to the molding material mixture as additives | |
| | Sodium water | | DM water | | |
| # | glass binder[b] [PBW] | NaOH[c] [PBW] | (additional) [PBW] | NaOH[d] [PBW] | Lithium compound |
| 3.1 | 70.8 | 3.1 | 26.1 | 0 | 0 |
| 3.2 | 70.8 | 3.1 | 26.1 | 5 | 0 |

TABLE 3-continued

| Composition of the binder and additive components used[a] | | | | | |
|---|---|---|---|---|---|
| | Composition of the water glass binders, which was already prepared prior to the experiment | | | Solid sodium and lithium compound added to the molding material mixture as additives | |
| | Sodium water | | DM water | | |
| # | glass binder[b] [PBW] | NaOH[c] [PBW] | (additional) [PBW] | NaOH[d] [PBW] | Lithium compound |
| 3.3 | 70.8 | 3.1 | 26.1 | 0 | 5 PBW $LiOH \bullet H_2O$[e] |

[a]Examples 3.1 to 3. in each case contain 25 PBW particulate amorphous silica, POS B-W 90 LD Manufacturer Possehl Erzkontor GmbH
[b]Sodium water glass 48/50 from BASF SE; $[SiO_2]/[M_2O]$ molar ratio approx. 2.82; solids content approx. 45.5%
[c]Fraction of sodium hydroxide flakes (Sigma-Aldrich) dissolved in binder
[d]Fraction of sodium hydroxide flakes (Sigma-Aldrich) added to the molding material mixture via the additive component.
[e]Lithium hydroxide-monohydrate (solid; supplier: Lomberg GmbH)

TABLE 4

| Composition of the binders used | | | | | | | |
|---|---|---|---|---|---|---|---|
| | Quantity of material concentration in mol/kg based on the binder | | | | $[SiO_2]/[M_2O]$ molar ratio | Quantity of material-ratio | |
| # | $[SiO_2]$ | $[Na_2O]$ | $[K_2O]$ | $[Li_2O]$[a] | (M = Li, Na, K) | $[Li_2O_{active}]/[M_2O]$ | |
| 1.1 | 4.52 | 2.01 | 0 | 0.05 | 2.20 | 0.023 | not according to the invention |
| 1.2 | 4.53 | 1.97 | 0 | 0.10 | 2.20 | 0.047 | according to the invention |
| 1.3 | 4.54 | 1.92 | 0 | 0.14 | 2.20 | 0.070 | according to the invention |
| 1.4 | 4.55 | 1.85 | 0 | 0.22 | 2.20 | 0.105 | according to the invention |
| 1.5 | 4.56 | 1.78 | 0 | 0.29 | 2.20 | 0.140 | according to the invention |
| 1.6 | 4.57 | 1.73 | 0 | 0.35 | 2.20 | 0.169 | according to the invention |
| 1.7 | 4.16 | 2.27 | 0 | 0.17 | 1.70 | 0.070 | not according to the invention |
| 1.8 | 4.29 | 2.15 | 0 | 0.16 | 1.85 | 0.070 | not according to the invention |
| 1.9 | 4.42 | 2.03 | 0 | 0.15 | 2.03 | 0.070 | according to the invention |
| 1.10 | 4.54 | 1.92 | 0 | 0.14 | 2.20 | 0.070 | according to the invention |
| 1.11 | 4.62 | 1.84 | 0 | 0.14 | 2.33 | 0.070 | according to the invention |
| 1.12 | 4.70 | 1.77 | 0 | 0.13 | 2.47 | 0.070 | according to the invention |
| 1.13 | 4.77 | 1.71 | 0 | 0.13 | 2.60 | 0.070 | not according to the invention |
| 2.1 | 4.06 | 1.65 | 0.19 | 0 | 2.21 | 0 | not according to the invention |
| 2.2 | 4.06 | 1.51 | 0.19 | 0.14 | 2.21 | 0.076 | according to the invention |
| 2.3 | 4.06 | 1.38 | 0.19 | 0.27 | 2.21 | 0.147 | according to the invention |

[a]For Examples 1.1 to 2.3, $[Li_2O]$ is equal to $[Li_2O_{active}]$, since the $LiOH \bullet H_2O$ added along with the inorganic binder component is included one hundred percent in $[Li_2O_{active}]$.

TABLE 5

| Composition of the binder and additive components used | | | | | | | | |
|---|---|---|---|---|---|---|---|---|
| | Quantity of material concentration in mol/kg | | | | | $[SiO_2]/[M_2O]$ molar ratio | amount of substance ratio | |
| # | $[SiO_2]$[a] | $[Na_2O]$[a] | $[Na_2O]$[b] | $[Li_2O]$[b] | $[Li_2O_{active}]$[b] | (M = Li, Na)[a] | $[Li_2O_{active}]/[M_2O]$[b] | |
| 3.1 | 3.93 | 1.78 | 1.78 | 0 | 0 | 2.21 | 0 | not according to the invention |
| 3.2 | 3.93 | 1.78 | 2.41 | 0 | 0 | 2.21 | 0 | not according to the invention |
| 3.3 | 3.93 | 1.78 | 1.78 | 0.60 | 0.20 | 2.21 | 0.08 | according to the invention |

[a]amount of substance concentration, calculated for the inorganic binder component.
[b]amount of substance concentration, calculated for the inorganic binder and additive components together.

The remainder of the respective molding material mixture for refilling the core shooting machine was stored in a carefully closed container to protect it from drying and to prevent premature reaction with $CO_2$ present in the air.

TABLE 6

Bending strengths of the test bars prepared

| # | Hot strengths [N/cm$^2$] | Cold strengths[a)] [N/cm$^2$] | After storage in climatic test cabinet[b)] [N/cm$^2$] | After storage in climatic test cabinet[c)] [%] | |
|---|---|---|---|---|---|
| 1.1 | 100 | 398 | 123 | 30.9 | not according to invention |
| 1.2 | 100 | 398 | 248 | 62.3 | according to the invention |
| 1.3 | 100 | 393 | 280 | 71.2 | according to the invention |
| 1.4 | 100 | 375 | 303 | 80.8 | according to the invention |
| 1.5 | 100 | 363 | 323 | 89.0 | according to the invention |
| 1.6 | 100 | 355 | 335 | 94.4 | according to the invention |
| 1.7 | 95 | 445 | 100 | 22.5 | not according to invention |
| 1.8 | 95 | 440 | 155 | 35.2 | not according to invention |
| 1.9 | 105 | 430 | 240 | 55.8 | according to the invention |
| 1.10 | 100 | 385 | 243 | 63.1 | according to the invention |
| 1.11 | 110 | 365 | 283 | 77.5 | according to the invention |
| 1.12 | 120 | 355 | 265 | 74.6 | according to the invention |
| 1.13 | 125 | 305 | 287 | 94.1 | not according to invention |
| 2.1 | 150 | 425 | 147 | 34.6 | not according to the invention |
| 2.2 | 130 | 378 | 268 | 70.9 | according to the invention |
| 2.3 | 140 | 313 | 310 | 99.0 | according to the invention |
| 3.1 | 140 | 378 | 88 | 23.3 | not according to invention |
| 3.2 | 65 | 340 | 15 | 4.4 | not according to invention |
| 3.3 | 130 | 380 | 305 | 80.3 | according to the invention |

[a)]The determination of the strengths was performed after 24 hours of storage at room temperature

[b)]The determination of the strengths was performed after 24 hours of storage in a climatic test cabinet at 30° C. and 60% relative atmospheric humidity following the storage at room temperature.

[c)]Remaining strengths after storage in the climatic test cabinet relative to the cold strength.

The molding material mixtures were introduced from the storage bunker into the molding tool using compressed air (5 bar). The residence time in the hot molding tool for curing the mixtures was 35 seconds. To accelerate the curing process, hot air (2 bar, 100° C. on entry into the tool) was passed through the molding tool during the last 20 seconds. The molding tool was opened and the test piece was removed.

2.3 Strength Tests on the Prepared Test Bars

To determine the bending strengths, the test bars were placed in a Georg Fischer strength testing device equipped with a 3-point bending device and the force that resulted in breakage of the test bar was measured. The bending strengths were determined both immediately, i.e., a maximum of 10 seconds after removal (hot strengths) and approx. 24 hours after preparation (cold strengths). The shelf life was investigated by subsequently storing the cores for an additional 24 hours in a climatic test cabinet (from Rubarth Apparate GmbH) at 30° C. and a relative atmospheric humidity of 60%, which corresponds to an absolute atmospheric humidity of 18.2 g/m$^3$, and their bending strength was measured again. The accuracy with which the specified values for temperature and atmospheric humidity were prepared by the climatic test cabinet was checked regularly with a calibrated testo 635 humidity/temperature/pressure dew point measuring device from the testo company.

The results of the strength tests are presented in Table 6. The values given here are mean values from multiple determinations on at least 4 cores.

2.4 Results

Whereas the binders of Examples 1.1 to 1.6 differ only in terms of their $[Li_2O_{active}]/[M_2O]$ amount of substance ratio, the binders of Examples 1.7 to 1.12 have a different molar ratio at a constant value for the $[Li_2O_{active}]/[M_2O]$ amount of substance ratio. Comparison of Examples 1.1 to 1.6 thus clarifies the effect of the amount of substance ratio $[Li_2O_{active}]/[M_2O]$ on the strength values, while Examples 1.7 to 1.12 reflect the effect of the $[SiO_2]/[M_2O]$ molar ratio.

Effect of the $[Li_2O_{active}]/[M_2O]$ Amount of Substance Ratio of the Binder:

The bending strengths summarized in Table 6 clearly confirm the positive effect that can be achieved by the addition of lithium on the shelf life of the binder.

Whereas the strengths of cores prepared with the binder of Example 1.1 decrease to 71% after storage for one day under elevated atmospheric humidity, the losses of strength of the cores prepared with the other, more lithium-rich binders are distinctly less pronounced. This effect occurs even in the case of binders with a relatively low $[Li_2O_{active}]/[M_2O]$ ratio of 0.047. Comparison of Examples 1.2 to 1.6 clearly shows that with increasing $[Li_2O_{active}]/[M_2O]$ amount of substance ratio the shelf life of the binder increases, such that a residual strength of 94%, based on the cold strength, after storage in the climatic test cabinet can be achieved.

With regard to the hot strength, Examples 1.1 to 1.6 do not exhibit any difference, whereas in the case of cold strengths with increasing $[Li_2O_{active}]/[M_2O]$ amount of substance ratio a significant worsening of the values by as much as 40 N/cm$^2$ is seen.

Examples 1.1 to 1.6 make it clear that the sand cores prepared with these binders have long shelf lives with simultaneously high cold strength. A further increase in the amount of substance ratio does not cause any significant improvement in the shelf life, whereas the cold strengths decrease.

These observations can be made both for mixed Li—Na water glasses and for mixed Li—Na—K water glasses, as demonstrated by Examples 2.1 to 2.3.

Example 3.3 clarifies the effect according to the invention for molding material mixtures in which the lithium compound was added as additive. Compared with Examples 3.1 and 3.2, not according to the invention, which do not contain any lithium, the shelf life of the cores prepared with these binders is distinctly elevated, whereas the cold strengths remain at the same good level.

Effect of the $[SiO_2]/[M_2O]$ Molar Ratio of the Binder:

As can be recognized based on Examples 1.7 to 1.13, with increasing molar ratio the hot strengths increase, whereas the cold strengths decrease.

In addition it can also be observed that the increasing molar ratio of the binder has a distinct positive effect on the shelf life of the prepared sand cores. Whereas for Examples 1.11 to 1.13 the strengths of the cores after storage in the climatic test cabinet increase with increasing molar ratio, because of the opposite trend of the decreasing cold strengths no absolute improvement can be achieved. Thus for the $[SiO_2]/[M_2O]$ molar ratio an optimum exists, which the binders of compositions 1.9 to 1.12 exhibit. A lower molar ratio leads to a distinctly reduced shelf life, whereas a further increase in the molar ratio has a negative effect on the cold strength.

3. Investigations on Viscosity of the Binders 3.1 Viscosity Measurements

Viscosity measurements were performed using a Brookfield viscometer fitted with a small sample adapter. In each case about 15 g of the binder to be tested were transferred into the viscometer and its viscosity measured with spindle 21 at a temperature of 25° C. and a rotation speed of 100 rpm. The results of the measurements are summarized in Table 7.

TABLE 7

Viscosity of the binders used

| # | Viscosity [mPa · s] | |
|---|---|---|
| 1.1 | 63 | not according to the invention |
| 1.2 | 64 | according to the invention |
| 1.3 | 66 | according to the invention |
| 1.4 | 66 | according to the invention |
| 1.5 | 71 | according to the invention |
| 1.6 | 79 | according to the invention |
| 1.7 | 78 | not according to the invention |
| 1.8 | 70 | not according to the invention |
| 1.9 | 66 | according to the invention |
| 1.10 | 66 | according to the invention |
| 1.11 | 63 | according to the invention |
| 1.12 | 68 | according to the invention |
| 1.13 | 73 | not according to the invention |
| 2.1 | 24 | not according to the invention |
| 2.2 | 25 | according to the invention |
| 2.3 | 27 | according to the invention |

3.2 Results

Whereas the binders of Examples 1.1 to 1.6 differ only in terms of their $[Li_2O_{active}]/[M_2O]$ amount of substance ratio, the binders of Examples 1.7 to 1.12 have a different $[SiO_2]/[M_2O]$ molar ratio at a constant value for the $[Li_2O_{active}]/[M_2O]$ amount of substance ratio. The comparison of Examples 1.1 to 1.6 thus clarifies the effect of the $[Li_2O_{active}]/[M_2O]$ amount of substance ratio on the viscosity, whereas Examples 1.7 to 1.12 reflect the effect of the molar ratio.

Effect of the $[Li_2O_{active}]/[M_2O]$ Amount of Substance Ratio of the Binder:

The viscosity values summarized in Table 7 make it clear that the viscosity of the binder increases with increasing $[Li_2O_{active}]/[M_2O]$ amount of substance ratio.

Effect of the $[SiO_2]/[M_2O]$ Molar Ratio of the Binder:

The viscosity of the binder passes through a minimum of the molar ratio in the area of the binders of Examples 1.9 to 1.11 according to the invention.

Effect of the $K_2O$ Fraction of the Binder:

In Examples 2.1 to 2.3 the viscosity is distinctly below the viscosity of the other examples because of the low solids content of these binders. The $K_2O$ dissolved in the binder on the other hand nonetheless has a positive effect on the viscosity, although this is not apparent from a comparison of the viscosity of Examples 2.1 to 2.3 with that of Examples 1.1, 1.3 and 1.5 because of the lower solids contents of Examples 2.1 to 2.3.

In summary it can be stated that the binders according to the invention of Examples 1.2 to 1.6, 1.9 to 1.12 and 2.2 to 2.3 represent an improvement compared with the prior art, since the sand cores prepared with them have good shelf life with simultaneously high cold strengths. In addition, the binders according to the invention are characterized by low viscosity values and thanks to their relatively low lithium contents, by low preparation costs.

4. Investigations on Core Wash Stability 4.1. Preparation and Strength Investigations on Test Pieces with Core Wash To investigate the core wash stability, water glass binders 2.1. and 1.3., whose preparation was described in 1., were used. The preparation of the molding material mixture or the test bars used is described in 2.1. and 2.2. The added quantities are identical to the statements made in 2.2., and particulate amorphous silica POS B-W 90 LD (Supplier: Possehl Erzkontor GmbH) was also used. As a further additive, 0.1 PBW glossy powdered graphite (Manufacturer: Luh) are added to the molding material mixture together with the amorphous $SiO_2$.

After preparation, the cores were held at room temperature for 24 hours for complete curing and then dipped into a core wash for 1 to 4 seconds.

The core wash was an aqueous, slightly alkaline core wash (pH=6.5-8.5) with a water content of approx. 51% and a viscosity of approx. 0.3-0.6 Pa·s at 25° C. (product MIRATEC W 8 from ASK Chemicals GmbH). The faced cores, i.e., coated with a thin film of the core wash, were immediately dried in a drying oven (Model FED 115, Binder Co.) at 100° C. An air change rate of 10 $m^3/h$ was achieved via an air feed pipe.

The bending strengths of the core wash-coated test bars were determined after 2, 6, 12 and 24 minutes, in each case after the beginning of the drying procedure. Table 8 summarizes the results of the strength tests. The values given here are mean values from 10 cores in each case. For comparison, the bending strength of test bars without core wash was determined.

TABLE 8

Bending strengths [$N/cm^2$] of the prepared test bars

| Residence time [min] in drying oven at 100° C./ after removal from the core wash bath | Water glass binder 2.1, not according to the invention | Water glass binder 1.3, not according to the invention |
|---|---|---|
| 0/no core wash | 415 | 385 |
| 2/with core wash | 280 | 260 |
| 6/with core wash | 90 | 230 |
| 12/with core wash | 150 | 235 |
| 24/with core wash | 255 | 250 |

4.2 Results

The bending strengths clearly demonstrate that the cores prepared with the molding material mixture according to the invention are far more stable compared with the aqueous core wash. Both the cores prepared with the binder according to the invention and the cores not prepared with the binder according to the invention pass through a strength minimum at approx. 6 minutes after being removed from the core wash bath before their strength increases distinctly again. At this time at which the strength minimum occurs the increased stability of the cores prepared with binder 1.3 according to the invention is clear. Whereas the cores prepared with binder 2.1, not according to the invention, decline to a strength of 90 $N/cm^2$, the cores prepared with binder 1.3 have a strength of 235 $N/cm^2$.

Especially for automated mass production, such a decrease in strength as that demonstrated in the example with binder 2.1 is extremely disadvantageous, since the prepared casting molds are not sufficiently resistant to mechanical stress at such low strength values.

The invention claimed is:

1. A method for preparing a molding material mixture, wherein the molding material mixture is prepared by bringing together at least three of the following components, each of which is provided separate from each another:

component (F) comprising at least a refractory basic molding material and no water glass;

component (B) comprising at least a water glass as inorganic binder wherein the water glass has a $[SiO_2]/[M_2O]$ molar ratio of 1.90 to 2.47 and does not comprise particulate amorphous $SiO_2$ and component (A) comprising at least particulate amorphous $SiO_2$ as an additive component and no water glass, wherein the components (A) and (B) together have a $[Li_2O_{active}]/[M_2O]$ molar ratio of 0.03 to 0.17 wherein $[M_2O]$ is the amount of substance in mol of alkali metal M, calculated as $M_2O$, wherein the calculation includes only the compounds: amorphous alkali silicates, alkali metal oxides and alkali metal hydroxides, including the hydrates of any included lithium compounds, wherein Li is included as part of M without an activity factor, $[Li_2O_{active}]$ is the amount of substance in mol Li, calculated as $Li_2O$, wherein the calculation includes only: amorphous lithium silicates, lithium oxide, lithium hydroxide, and any hydrates thereof, $[SiO_2]$ is the amount of substance in mol Si, calculated as $SiO_2$, wherein the calculation includes only amorphous alkali silicates, wherein an activity factor enters into the calculation of the molar amount of $[Li_2O_{active}]$ as follows:

$[Li_2O_{active}]$=1*amorphous lithium silicates, which are added as constituents of the inorganic binder component (B), calculated as mol $Li_2O$, +

1*lithium oxide, which is added as a constituent of the inorganic binder component (B), calculated as mol $Li_2O$, +

1*lithium hydroxide, which is added as a constituent of the inorganic binder component (B), calculated as mol $Li_2O$ +

0.33*amorphous lithium silicates, which are not added as a constituent of the inorganic binder component (B), calculated as mol $Li_2O$, +

0.33*lithium oxide, which is not added as a constituent of the inorganic binder component (B), calculated as mol $Li_2O$, +

0.33*lithium hydroxide, which is not added as a constituent of the inorganic binder component (B), calculated as mol $Li_2O$, in each case including the hydrates thereof, wherein the component (B) comprises at least one of: lithium oxide, lithium hydroxide, amorphous lithium silicate, and any hydrates thereof.

2. The method of claim 1, wherein the particulate amorphous $SiO_2$ has a BET of greater than or equal to 1 $m^2/g$.

3. The method of claim 1, wherein the mean particle diameter, determined by dynamic light scattering, of the particulate amorphous $SiO_2$ in the molding material mixture is between 0.05 μm and 10 μm.

4. The method of claim 1, wherein the molding material mixture contains the particulate amorphous $SiO_2$ in quantities of 0.1 to 2 wt. %, based on the basic molding material, and independently thereof 2 to 60 wt. %, based on the weight of the binder, wherein the solids fraction of the binder amounts to 20 to 55 wt. %.

5. The method of claim 1, wherein the amorphous $SiO_2$ used has a water content of less than 15 wt. %, and independently thereof is used as a flowable powder.

6. The method of claim 1, wherein the molding material mixture contains a maximum of 1 wt % organic compounds.

7. The method of claim 1, wherein the inorganic binder component (B) has a $[K_2O]/[M_2O]$ molar ratio of 0.03 to 0.25 in the inorganic binder.

8. The method of claim 1, wherein:

the water glass is present in the molding material in an amount of 0.2 to 2.5 wt. % soluble alkali silicates relative to the basic molding material and calculated as the oxides thereof, and/or the binder has a solids fraction of greater than or equal to 20 wt. % and less than or equal to 55 wt. %, based on the binder.

9. The method of claim 1, wherein the lithium compound is added exclusively as a constituent of the inorganic binder.

10. The method of claim 1, wherein the molding material mixture furthermore contains at least one surfactant.

11. The method of claim 10, wherein the at least one surfactant is present in the molding material mixture in a fraction of 0.001 to 1 wt. %, based on the weight of the refractory basic molding material.

12. The method of claim 1, wherein the $[SiO_2]/[M_2O]$ molar ratio is from 1.95 to 2.40.

13. The method of claim 1, wherein the $[Li_2O_{active}]/[M_2O]$ molar ratio is 0.035 to 0.16.

14. The method of claim 1, wherein the at least one of amorphous lithium silicates, lithium oxide, lithium hydroxide, and any hydrates thereof, are present in homogeneous solution in the binder or in homogeneous solution in component (B).

15. The method of claim 1, wherein the quantity $[Li_2O_{active}]$ is defined as the amount of substance in mol of Li, calculated as $Li_2O$, exclusive of the following compounds: amorphous lithium silicates and/or lithium hydroxide, including the hydrates of any lithium-containing compound.

16. The method of claim 1, wherein the at least one of: lithium oxide, lithium hydroxide, amorphous lithium silicate and the hydrates thereof, are completely and homogeneously dissolved, without precipitate, in an aqueous solvent as a constituent of the lithium containing binder or of component (B).

17. An inorganic binder (B) comprising at least water glass as the inorganic binder and having a $[SiO_2]/[M_2O]$ molar ratio of 1.9 to 2.47 in the inorganic binder (B) and a $[Li_2O_{active}]/[M_2O]$ molar ratio of 0.04 to 0.14 in the inorganic binder (B), wherein $[M_2O]$ is the amount of substance in mol of alkali metal M, calculated as $[M_2O]$, wherein the calculation includes only the compounds: amorphous alkali silicates, alkali metal oxides and alkali metal hydroxides, including the hydrates of any included lithium compounds, wherein Li is included as part of M without an activity factor, $[Li_2O_{active}]$ is the amount of substance in mol Li, calculated as $[Li_2O]$, wherein only the following compounds enter into the calculation: amorphous lithium silicates, lithium oxides, lithium hydroxide, and any hydrates thereof, $[SiO_2]$ is the amount of substance in mol Si, calculated as $[SiO_2]$, wherein only the following compounds enter into the calculation: amorphous alkali silicates, and an activity factor is included in $[Li_2O_{active}]$ as follows:

$[Li_2O_{active}]$=1*amorphous lithium silicates, which are added as a constituent of the inorganic binder component (B), calculated as mol $[Li_2O]$, +

1*lithium oxide, which is added as a constituent of the inorganic binder component (B), calculated as mol $[Li_2O]$+

1*lithium hydroxide, which is added as a constituent of the inorganic binder component (B), calculated as mol $[Li_2O]$, in each case including the hydrates thereof, and wherein the lithium oxide, lithium hydroxide, amorphous lithium silicate and the hydrates thereof are present in a homogenous solution in the lithium containing binder.

18. The binder of claim 17, wherein the binder has a $[SiO_2]/[M_2O]$ molar ratio of 1.95 to 2.40.

19. The binder of claim 17, wherein the binder furthermore comprises surfactants.

20. The binder of claim 17, wherein the binder has a $[K_2O]/[M_2O]$ molar ratio of 0.03 to 0.25.

21. A method for preparing casting molds or cores comprising:

the method for preparing the molding material mixture according to claim 1, introducing the molding material mixture into a mold, and curing the molding material mixture.

22. The method of claim 21, wherein the molding material mixture is introduced into the mold by using a core shooting machine operated by compressed air and the mold is a molding tool and the molding tool has one or more gases passing through.

23. The method of claim 21, wherein the molding material mixture is exposed to a temperature of at least 100° C. for less than 5 min for curing.

24. The method of claim 21, wherein a gas is passed through the molding material mixture for curing it and said gas has a temperature of 100 to 180° C.

* * * * *